US012472546B2

(12) United States Patent
Jungen et al.

(10) Patent No.: US 12,472,546 B2
(45) Date of Patent: Nov. 18, 2025

(54) DRAWING MACHINE, DRAWING METHOD AND DRAWING MANDREL

(71) Applicant: SMS group GmbH, Duesseldorf (DE)

(72) Inventors: Hardy Jungen, Moenchengladbach (DE); Ulf Serode, Moenchengladbach (DE); Karl Thoelke, Kempen (DE)

(73) Assignee: SMS group GmbH, Duesseldorf (DE)

( * ) Notice: Subject to any disclaimer, the term of this patent is extended or adjusted under 35 U.S.C. 154(b) by 337 days.

(21) Appl. No.: 17/914,138

(22) PCT Filed: Mar. 26, 2021

(86) PCT No.: PCT/DE2021/100306

§ 371 (c)(1),
(2) Date: Sep. 23, 2022

(87) PCT Pub. No.: WO2021/190710

PCT Pub. Date: Sep. 30, 2021

(65) Prior Publication Data

US 2023/0130543 A1 Apr. 27, 2023

(30) Foreign Application Priority Data

Mar. 26, 2020 (DE) ..... 10 2020 108 425.0

(51) Int. Cl.
*B21C 1/24* (2006.01)
*B21C 3/16* (2006.01)

(52) U.S. Cl.
CPC . *B21C 1/24* (2013.01); *B21C 3/16* (2013.01)

(58) Field of Classification Search
CPC .. B21C 1/24; B21C 3/16; B21C 51/00; B21B 37/78
See application file for complete search history.

(56) References Cited

U.S. PATENT DOCUMENTS 3,705,506 A * 12/1972 Clavin ..... B21D 9/00 72/380
3,747,054 A * 7/1973 Arvanetakis ..... H04B 11/00 340/13.23

(Continued)

FOREIGN PATENT DOCUMENTS

DE 943 044 C 5/1956
DE 196 10 642 A1 9/1997

(Continued)

OTHER PUBLICATIONS

KR 101496088B1, Korea Feb. 2015.*

(Continued)

*Primary Examiner* — Edward T Tolan
(74) *Attorney, Agent, or Firm* — Collard & Roe, P.C.

(57) ABSTRACT

To provide methods, apparatuses and drawing mandrels in which the shaping process can be monitored as closely as possible, a drawing machine and a drawing method manufactures or processes tubes, which extend in the direction of longitudinal extent, from a semi-manufactured product, wherein the drawing machine includes a drawing device for drawing a hollow workpiece formed by the tube and the semi-manufactured product in the direction of longitudinal extent, a drawing ring and a drawing mandrel and acts on the workpiece in a shaping manner via the drawing mandrel and the drawing ring while the workpiece is drawn by the drawing device around the drawing mandrel and through the drawing ring. A sensor is located on the drawing mandrel, or physical properties are measured in the interior of the workpiece and/or on the drawing mandrel using a sensor on the drawing mandrel.

22 Claims, 3 Drawing Sheets

(56) References Cited

U.S. PATENT DOCUMENTS

Figure 1:
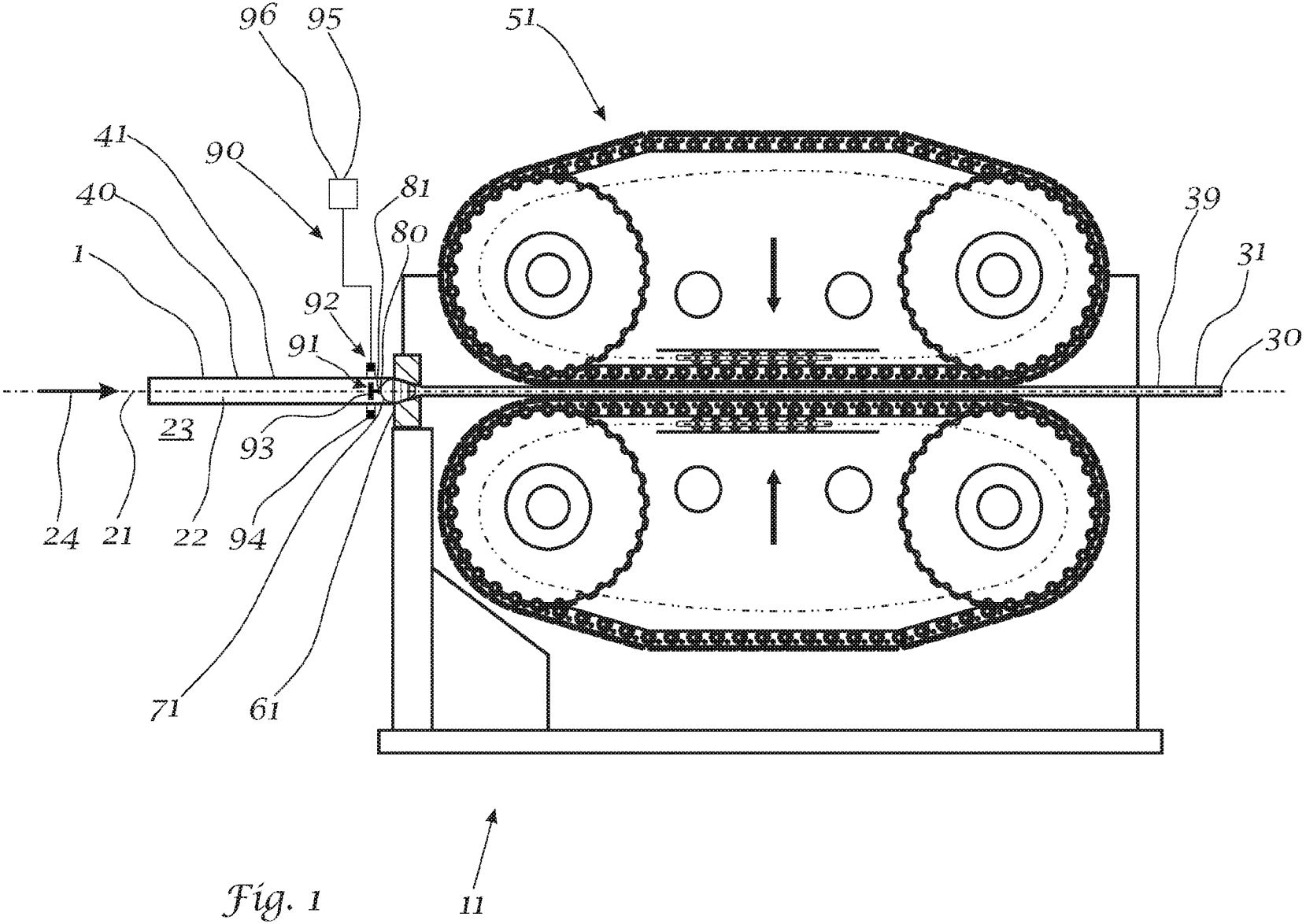

| | | | | |
|---|---|---|---|---|
| 4,573,336 | A | 3/1986 | Hagglund | |
| 5,548,987 | A * | 8/1996 | Hausler | B21B 33/00 72/14.3 |
| 5,651,638 | A * | 7/1997 | Heggerud | F16L 55/48 405/154.1 |
| 6,354,123 | B1 * | 3/2002 | Rajagopalan | F16L 55/48 72/17.2 |
| 8,434,567 | B2 * | 5/2013 | Menezes | E21B 7/068 175/45 |
| 8,627,703 | B2 | 1/2014 | Corder | |
| 10,071,408 | B2 * | 9/2018 | Hanada | B21C 1/24 |
| 10,913,099 | B2 * | 2/2021 | Mihailescu | B21D 17/00 |
| 11,402,337 | B2 * | 8/2022 | Martin | G01M 3/246 |
| 2019/0022737 | A1 * | 1/2019 | Ma | B21J 15/12 |
| 2020/0048994 | A1 * | 2/2020 | Arsalan | E21B 17/1078 |

FOREIGN PATENT DOCUMENTS

| | | | |
|---|---|---|---|
| DE | 199 02 501 | A1 | 7/2000 |
| DE | 10 2009 061 264 | B3 | 5/2016 |
| DE | 10 2015 112 010 | A1 | 1/2017 |
| EP | 0 780 171 | A1 | 6/1997 |
| GB | 2 529 844 | A | 3/2016 |
| JP | S56-004311 | A | 1/1981 |
| JP | S61-177826 | A | 8/1986 |
| JP | S63-84721 | A | 4/1988 |
| JP | S63-159719 | A | 7/1988 |
| JP | H02-99216 | A | 4/1990 |
| JP | H04-155231 | A | 5/1992 |
| JP | H06-56737 | U | 8/1994 |
| JP | H10-225712 | A | 8/1998 |
| JP | 2013-237085 | A | 11/2013 |
| WO | 88/06087 | A1 | 8/1988 |

OTHER PUBLICATIONS

DE 3133804C, Hone et al. May 1983.*
JP 59-225811A, Kazinuma et al. Dec. 1984.*
DE 19711028A1, Bueltmann et al. Sep. 1998.*
JP 01-170513A, Fujii et al. Jul. 1989.*
JP 59-225811A, Kakinuma et al. Dec. 1984.*
Translation JP 59-225811A, Kakinuma et al. Dec. 1984.*
CN 205538829U, Wu et al. Aug. 2016.*
CN 205765990U, Huang Dec. 2016.*
International Search Report in PCT/DE2021/100306, dated Jul. 28, 2021.
Short list of German Search Report in DE 10 2020 108 425.0, dated Feb. 9, 2021, with English translation.
Office Action of Japanese Patent Application No. 2022-548674, dated Nov. 11, 2024, with Search Report (With English Translation).
Office Action in Japanese Patent Application No. 2022-548674, dated Jun. 17, 2025 (With English Translation).

* cited by examiner

DRAWING MACHINE, DRAWING METHOD AND DRAWING MANDREL

CROSS REFERENCE TO RELATED APPLICATIONS

This application is the National Stage of PCT/DE2021/100306 filed on Mar. 26, 2021, which claims priority under 35 U.S.C. § 119 of German Application No. 10 2020 108 425.0 filed on Mar. 26, 2020, the disclosure of which is incorporated by reference. The international application under PCT article 21(2) was not published in English.

The invention relates to a drawing machine, a drawing method, and a drawing mandrel.

In particular, the invention relates to drawing machines for the production or machining of tubes composed of a semi-finished product, which tubes extend in the longitudinal expanse direction, wherein the drawing machines comprise, in each instance, a drawing device for drawing a hollow workpiece formed by the tube and the semi-finished product along the longitudinal expanse direction, a drawing ring, and a drawing mandrel, and act on the workpiece, forming it, while the workpiece is being drawn around the drawing mandrel and through the drawing ring, under the control of the drawing device. Also the invention relates to drawing methods for the production or machining of tubes composed of a semi-finished product, which extend in a longitudinal expanse direction, wherein a hollow workpiece formed by the tube and the semi-finished product is drawn along the longitudinal expanse direction with a drawing device, and the workpiece is acted on, forming it, with a drawing ring and a drawing mandrel, while it is being drawn around the drawing mandrel and through the drawing ring, under the control of the drawing device. Likewise, the invention relates to a drawing mandrel for use in a drawing machine and/or in a drawing method for the production or machining of tubes that extend in a longitudinal expanse direction, from a semi-finished product.

Such drawing machines, drawing methods, and drawing mandrels are known from EP 0 780 171 A1, which measure and monitor the vibrations of the drawing system by means of an inductive sensor system arranged around the outside of the workpiece and/or by means of at least one strain gauge at the end of a stopper rod that carries a mandrel or on the holder of the rod.

It is the task of the present invention to make available methods and apparatuses of the stated type, in which the forming process can be monitored in the best manner possible.

The task of the invention is accomplished by means of methods and apparatuses as well as drawing mandrels having the characteristics of the independent claims. Further advantageous embodiments, if applicable also independent of these, are found in the dependent claims as well as in the following description.

In order to make available a drawing machine in which the drawing process can be monitored in the best manner possible, the drawing machine for the production or machining of tubes composed of a semi-finished product, which extend in the longitudinal expanse direction, wherein the drawing machine comprises a drawing device for drawing a hollow workpiece formed by the tube and the semi-finished product along the longitudinal expanse direction, a drawing ring, and a drawing mandrel, and acts on the workpiece, forming it, with the drawing mandrel and the drawing ring, while it is being drawn around the drawing mandrel and through the drawing ring, under the control of the drawing device, can be characterized in that the drawing machine comprises an apparatus transmitting date from the interior of the workpiece, using a transmitter arranged in the interior of the workpiece and a receiver arranged outside of the workpiece, and the receiver and the transmitter can communicate with one another wirelessly.

Furthermore, in order to make available apparatuses of the stated type, in which the forming process can be monitored in the best manner possible, a drawing machine for the production or machining of tubes composed of a semi-finished product, which extend in the longitudinal expanse direction, wherein the drawing machine comprises a drawing device for drawing a hollow workpiece formed by the tube and the semi-finished product along the longitudinal expanse direction, a drawing ring, and a drawing mandrel, and acts on the workpiece, forming it, with the drawing mandrel and the drawing ring, while it is being drawn around the drawing mandrel and through the drawing ring, under the control of the drawing device, can be characterized in that the position of the sensor in three-dimensional space and/or the temperature and/or the pressure and/or the acceleration can be measured by means of a sensor arranged on the drawing mandrel.

In order to make methods of the stated type available, in which the forming process can be monitored in the best manner possible, a drawing method for the production or machining of tubes composed of a semi-finished product, which extend in the longitudinal expanse direction, wherein a hollow workpiece formed by the tube and the semi-finished product is drawn along the longitudinal expanse direction with a drawing device, and acts on the workpiece, forming it, with a drawing mandrel and a drawing ring, while it is being drawn around the drawing mandrel and through the drawing ring, under the control of the drawing device, can be characterized in that a transmitter is arranged in the interior of the workpiece, which transmits a signal that comprises data, out of the workpiece, to a receiver arranged outside of the workpiece, and the receiver and the transmitter communicate with one another wirelessly.

Furthermore, in order to make methods of the stated type available, in which the forming process can be monitored in the best manner possible, a drawing method for the production or machining of tubes composed of a semi-finished product, which extend in the longitudinal expanse direction, wherein a hollow workpiece formed by the tube and the semi-finished product is drawn along the longitudinal expanse direction with a drawing device, and acts on the workpiece, forming it, with a drawing mandrel and a drawing ring, while it is being drawn around the drawing mandrel and through the drawing ring, under the control of the drawing device, can be characterized in that a sensor arranged on the drawing mandrel measures the position of the sensor in three-dimensional space and/or the temperature and/or the pressure and/or the acceleration.

In order to make drawing mandrels of the stated type available, in which the forming process can be monitored in the best manner possible, a drawing mandrel for use in a drawing machine and/or in a drawing method for the production or machining of tubes composed of a semi-finished product, which extend in a longitudinal expanse direction, can be characterized in that the drawing mandrel is a floating drawing mandrel and that a sensor is arranged on the drawing mandrel.

Also, in order to make drawing mandrels of the stated type available, in which the forming process can be monitored in the best manner possible, a drawing mandrel for use in a drawing machine and/or in a drawing method for the production or machining of tubes composed of a semi-finished product, which extend in a longitudinal expanse direction, can be characterized in that the position of the sensor in three-dimensional space and/or the temperature and/or the pressure and/or the acceleration can be measured by means of the sensor.

In contrast to pure monitoring or determination of the position of the drawing mandrel by means of an apparatus in which no sensor is directly arranged on the drawing mandrel, in other words from the outside, the actual properties at the drawing mandrel can be determined and monitored immediately and directly by means of the sensor on the drawing mandrel, by the corresponding sensor. This makes it possible, for the first time, to monitor the drawing mandrel directly, so as to be able to act on the drawing process in a targeted manner in this way.

It is understood that the sensor can carry out its measurements, if necessary, also in interplay with components arranged outside the workpiece, such as, for example, coordinate transmitters arranged on the outside, and the like.

In particular, the transmitter can be configured in such a manner that it transmits or can transmit a signal that comprises the data through the wall of the workpiece. This can be dome, for example, by means of the selection of a suitable transmission frequency, which makes it possible for this frequency to pass through the wall of the workpiece to a sufficient extent.

On the other hand, it is understood that a corresponding signal can also be transmitted along the longitudinal expanse direction of the workpiece, until this signal reaches a workpiece end at which it can be received by the receiver. Here, too, it can be advantageous to select suitable frequencies, coordinated with the workpiece, which propagate with an amplitude that is as sufficient as possible along the corresponding hollow body, which is made available by the workpiece due to its nature.

The corresponding selection of the frequencies can easily take place, in this regard, on the basis of the material, the wall thickness, the length and/or the diameter of the corresponding workpiece, since on the basis of this information, the penetration depths of the corresponding signals into and through materials and/or their ability to run in a hollow body are actually known or can be determined by means of simple experiments.

In total, however, it has turned out that it is particularly advantageous if the transmitter transmits or can transmit a signal that comprises the data through the wall of the workpiece, if this is possible due to the wall thickness of the corresponding workpiece and its material, since this, in total, allows a relatively simple structure of transmitter and receiver.

Accordingly, it is particularly advantageous if the receiver is arranged at the axial height of the transmitter, with reference to the longitudinal expanse direction. This makes a short path distance between transmitter and receiver possible, and this is accordingly also advantageous for the signal strength. In this regard, it is understood that within the scope of sufficient signal strength, a slightly greater distance between transmitter and receiver, perpendicular to the longitudinal expanse direction, can certainly be provided. Also in the longitudinal expanse direction, it can be assumed, in the case of distances that do not exceed three times the workpiece diameter, that sufficient signal strength will still be found, in an operationally reliable manner, and that such a distance can still be considered as being at the "axial height."

It is understood that the sensor preferably has a transmitter. This is understood to mean that the sensor is connected with the transmitter, which makes the latter part of the sensor. In particular, it is conceivable, of course, that the transmitter or parts of the transmitter and the other modules of the sensor are combined structurally into a unit, for example can be found on a microchip. Such a close connection between sensor and transmitter simplifies the structure and makes it possible, for example, for the sensor to address or control the transmitter directly.

Preferably the transmitter is an electric or preferably an electronic transmitter. In this manner, measured values recorded by the sensor using a measured value recorder, for example, can easily be processed further or passed on. Also such an embodiment makes it possible that corresponding electric or electronic signals can be transmitted rapidly, in a relatively uncomplicated manner, and with relative operational reliability.

It is understood that the sensor can comprise a measured value recorder, which detects possible measured values. In order to be able to process the recorded measured values further, these can be passed on by way of an electric or preferably electronic transmitter, wherein passing them on by way of electronic transmitters, for example, can take place with the greatest possible precision and in a loss-free manner.

Alternatively or cumulatively to this, the sensor can also have a microcontroller, and thereby a measured value or signal can already be edited or processed on the drawing mandrel. Thus as many sources for measurement errors, for example an extended data transmission, can be minimized as much as possible. It is understood that corresponding editing or processing does not necessarily have to take place on the sensor or on the drawing mandrel in final form, but rather further editing or processing steps can still follow.

The sensor can thereby represent a measured value recorder of any kind, as such. Also, the sensor can comprise an overall arrangement, for example composed of measured value recorder and/or signal editing and/or signal processing, such as, for example, by means of a microcontroller or similar instruments for signal editing or signal processing.

It is conceivable that a transmitter coupled with the sensor is arranged within the workpiece, and a receiver is arranged outside the workpiece, wherein the receiver and the transmitter communicate with one another in a wired manner. The wired communication between transmitter and receiver is relatively immune to interference, since a direct continuous connection between transmitter and receiver is made available, by way of which communication between transmitter and receiver can take place. Furthermore, the wired connection between transmitter and receiver can also be used for the purpose of energy supply, so as to make energy, for example for the transmitter or for other functionalities of the sensor available accordingly, wherein, for example, the measured value recorder, the microcontroller or further units situated on the drawing mandrel can be supplied with energy. Furthermore, due to the wired communication between transmitter and receiver, interface lines are also possible, and this ensures varied possibilities of use.

Cumulatively or alternatively to this, the receiver and the transmitter can communicate with one another, particularly wirelessly, and this is particularly advantageous in the case of very long workpieces or in the case of communication provided through the wall of the workpiece, since then a longer wire is not required. In particular in the case of drawing machines that are part of heavy machine construction, the workpieces can be very long, and therefore a correspondingly long wire is necessary between transmitter and receiver, which wire might be disadvantageous for the apparatus.

In the present case, the workpiece, the semi-finished product or the tube should be understood, in particular, to be a hollow body. This body can then represent the tube or the semi-finished product, in particular. A drawing machine of the stated type or a drawing method of the stated type can serve for the production or machining of the said tubes from a semi-finished product, wherein both the tubes composed of a semi-finished product and the hollow workpiece extend along a longitudinal expanse direction.

The longitudinal expanse direction is preferably also the direction in which the tubes are produced or processed by the drawing machine. The longitudinal expanse direction can therefore also be the direction of the center axis of the tube, of the semi-finished product or of the hollow workpiece, at the same time.

Because the workpiece can be a hollow body, as has been explained above, the transmitter, which is coupled with the sensor, is preferably arranged within the workpiece. Within the workpiece therefore means the hollow space of the body or of the workpiece, of the semi-finished product or of the tube, so that within the body can be defined as the space that is situated between the center axis of the workpiece and the inside surface of the corresponding body.

It is understood that the inner surface of the workpiece or of the tube is a surface that faces in the direction of the center axis of the workpiece or of the tube, while an outer surface of the workpiece or of the tube accordingly represents the surface that faces to the outside, lying opposite to the inner surface. By its nature, the outer surface of a tube is larger than the inner surface of the same tube.

Therefore outside of the workpiece also describes the region that borders on the outer surface of the workpiece.

It is advantageous if the wireless communication between transmitter and receiver is configured electrically, in particular capacitively. It has been shown that this is particularly advantageous for electrically conductive workpieces, which are excited electrically, in particular capacitively, wherein then a signal is conducted, for example, from an inner workpiece surface to the outer workpiece surface. A corresponding electrical signal can then be conducted to the receiver, in particular, in the near field or directly through the workpiece. In particular, capacitive communication can be advantageous in this regard. Wireless transmission between sensor and receiver has proven to certainly be difficult in the case of metallic workpieces, since depending on the material and the dimensions of the workpiece, in particular the workpiece thickness, no signal to absolutely no signal can be received by the receiver. This is, of course, attributable to the physical properties of the corresponding workpiece and the manner of signal transmission, which cannot always get through the material.

Cumulatively or alternatively, magnetic, in particular inductive communication can also be provided. Here, too, it is ultimately dependent on the concrete circumstances of the workpiece, such as diameter, material, and wall thickness, as to whether or not this form of communication can be used. In the case of workpieces having a permeability close to 1, magnetic, in particular inductive communication between transmitter and receiver can be advantageous, wherein a magnetic or inductive signal can be conducted through a workpiece wall, from the inside to the outside. Here, too, near-field properties, in particular, can be utilized in an advantageous manner.

Preferably, the wireless communication between sensor and receiver can also be configured electromagnetically, and this is advantageous, for example, if the hollow body as such is used as a hollow conductor for passing the signal on, or if the penetration depth of the electromagnetic signal into the material of the workpiece is sufficient to penetrate this material to the required extend.

It is advantageous if the transmitter is arranged on the drawing mandrel. In this way, the transmitter can be easily positioned with reference to the sensor, and a data connection or an electrical connection can be easily implemented.

A drawing machine of the stated type can comprise a drawing ring and a drawing mandrel, and can act on the workpiece, so as to form it, using the drawing mandrel and the drawing ring. In this regard, the drawing ring is preferably arranged outside of the workpiece, and the drawing mandrel is arranged within the workpiece, so that the drawing ring acts on the outer surface of the workpiece, so as to form it, primarily or by means of direct contact with it, while the drawing mandrel accordingly acts on the workpiece, so as to form it, by way of the inner surface of the workpiece, primarily or by means of direct contact with it.

Since thereby forming of the workpiece by means of the drawing mandrel takes place in the interior of the workpiece, and the transmitter can be arranged in the interior of the workpiece, it is advantageous to arrange the transmitter on the drawing mandrel, so that the transmitter cannot be damaged, for example due to the forming that takes place in the interior of the workpiece, since it can be positioned, in this regard, at a suitable position on the drawing mandrel. Thereby effective positioning of the transmitter can be made available for a data connection or electrical connection. Also, by means of this measure, it is possible to do without a further or separate module that has to be introduced into the workpiece.

Since the data transmission between transmitter and receiver through the workpiece can generally represent a challenge due to the losses, it can be advantageous, i.e. this can be counteracted if higher energies for the sensor or, in particular, for the transmitter could be made available, so as to be able to increase the performance capacity in this way. The greater the signal strength of the transmitter turns out to be, the greater the signal that gets through the workpiece is, as well. In order to make greater energies available for this, the sensor or the transmitter can comprise, in particular, a storage unit for electrical energy.

Preferably the storage unit is configured as a battery or rechargeable battery, since the energy storage unit can be recharged after every forming process, if necessary, so that if possible, a maximum signal strength of the sensor or of the transmitter can always be made available, and thereby the measurement quality as a whole can be improved.

In order to make available methods and apparatuses of the stated type, as well as a drawing mandrel, in which the forming process can be monitored in the best manner possible, an apparatus for transmitting date from the interior of a hollow workpiece that extends in the longitudinal expanse direction, in particular also for use in a drawing machine, can be characterized in that a transmitter that can transmit a signal that comprises the data through the wall of the workpiece, is provided in the interior of the workpiece, and that a receiver is provided, preferably outside of the workpiece, at an axial height of the transmitter, with reference to the longitudinal expanse direction, and the receiver and the transmitter can communicate wirelessly with one another. By means of the advantageous embodiment mentioned above, advantageous communication can be made available, in particular in the case of very long workpieces and in the case of communication through the wall of the workpiece, since a long wire or a long signal path is not necessary. Because the wire would have to lead from the transmitter through the entire length of the workpiece that has already been formed, all the way to the receiver that is situated outside of the workpiece, this wire would have to be configured in a disadvantageously long manner in the case of very long workpieces.

The drawing machine comprises a drawing device for drawing, through which the workpiece is also drawn around the drawing mandrel and through a drawing ring, wherein drawing mandrel and drawing ring act on the workpiece, forming it. The drawing direction in which the drawing device of the drawing machine draws a hollow workpiece formed by the tube and the semi-finished product is preferably the same as the longitudinal expanse direction, and can preferably be the same as the direction of the center axis of the workpiece.

The receiver can be placed at the axial height of the transmitter in the longitudinal expanse direction, because on the basis of the physical transmission methods of the signal by the transmitter, the strongest signal can generally be received by the receiver in this way. The best possible transmission of the measured values can be made available in this manner. As has already been explained above, it can be assumed that in the case of distances that do not exceed three times the workpiece diameter, sufficient signal strength will still be found, in operationally reliable manner, and such a distance can still be considered as being situated at the "axial height."

It is advantageous if the transmitter comprises a transmission coil, for example so as to make inductive transmission possible. Inductive transmission has proven to be extremely advantageous in the case of workpieces composed of a material, in particular also of a metallic material, having a permeability close to 1, so as to be able to emit magnetic signals outward from the interior of the workpiece, by means of the transmission coil.

In order to allow corresponding communication with a magnetically or inductively working transmitter/receiver pair, the receiver can comprise a reception coil that surrounds the workpiece. Therefore the reception coil can be arranged at the axial height of the transmission coil in the longitudinal expanse direction, so as to make available the most optimal arrangement between transmitter and receiver in the case of inductive signal transmission. In the case of the above arrangement, mentioned as an example, the distance between transmitter and receiver is as small as possible, i.e. the beam direction produced by the transmitter can be received by the reception coil in the best manner possible.

It is advantageous if the receiver comprises a receiver, which can make simple implementation of signal amplification or noise suppression possible. Since great losses can naturally occur due to the wall of the hollow body and, in particular, due to interference during drawing, it can be necessary to amplify the signal for further processing or to suppress or filter out noise and/or interference. Because only a few percent or even per mille of the signal can arrive through the wall of the hollow body, outside of the hollow body, depending on the workpiece properties and workpiece dimensions, the maximum amplification possible of the received signal can be advantageous.

Alternatively or cumulatively to this, the receiver can comprise a micro-controller, so as to make corresponding signal editing or processing available. Preferably data evaluation can also take place directly by means of the micro-controller.

Diverse physical properties, both in the interior of the workpiece and on the drawing mandrel, can be of interest for the drawing process, because these can directly influence the drawing behavior or the workpiece behavior or the drawing mandrel behavior. For this reason, various physical properties can also be important. For example, the physical properties in the interior of the workpiece as such, or also directly on the drawing mandrel can be of importance for the drawing behavior, so that can be measured accordingly.

In order to make available relatively noise-immune data transmission between transmitter and receiver, in an embodiment a transmitter can be arranged within the workpiece, which transmits data to a receiver arranged outside of the workpiece, in wired manner. In addition, the transmitter or receiver can also be supplied with energy by way of the wired connection. For example, a serial interface line is also possible.

Alternatively or cumulatively to this, as has already been explained above, a transmitter arranged within the workpiece can transmit data wirelessly to a receiver arranged outside of the workpiece, and this has the advantage that in the case of very long workpieces, transmission of the data can take place through the wall of the workpiece, and thereby a long wire between transmitter and receiver, through the entire length of the workpiece, which has already been formed, is not necessary.

Preferably the data are transmitted between transmitter and receiver electrically, in particular capacitively. Capacitive transmission appears to be particularly advantageous for electrically conductive workpieces that are capacitively excited and then conduct a signal from an inner workpiece surface to the outer workpiece surface, for example, as has been shown in corresponding experiments.

It is also conceivable that the data are transmitted between transmitter and receiver magnetically, in particular inductively; this is particularly advantageous for workpieces having a permeability close to 1, so that a magnetic or inductive signal can be passed through a workpiece wall, from the inside to the outside.

Also the data can be transmitted electromagnetically between transmitter and receiver, if, for example, the hollow workpiece is utilized as a hollow conductor for passing on the signal, which makes effective data transmission possible electromagnetically.

In order to already make measured value or signal editing or processing available on the drawing mandrel, a micro-controller arranged on the drawing mandrel can process the data of the sensor further. By means of the direct further processing, possible signal losses or measurement inaccuracies can be minimized, since the directly measured and almost loss-free signal is processed further directly on the sensor.

In order to make available methods and apparatuses as well as drawing mandrels of the stated type, in which the forming process can be monitored in the best manner possible, a method for transmission of data from the interior of a hollow workpiece that extends in the longitudinal expanse direction can be characterized in that a transmitter is arranged in the interior of the workpiece, which transmits a signal that comprises the data through the wall of the workpiece, wherein preferably a receiver is arranged outside of the workpiece, at the axial height of the transmitter with reference to the longitudinal expanse direction, and the receiver and the transmitter communicate wirelessly with one another. This wireless communication between transmitter and receiver is advantageous, in particular, in the case of very long workpieces, in the case of transmission through the wall of the workpiece, since the transmitter does not have to transmit the data over a long wire, all the way to the receiver.

It is advantageous if the data are transmitted by way of a transmission coil, which of course can allow inductive transmission by its nature. Inductive transmission of the data is advantageous, in particular, with workpieces that consist of a material, in particular also of a metallic material, having a permeability close to 1, so as to emit magnetic signals outward.

It is advantageous if the data are received by a reception coil of the receiver that surrounds the tube, because this, in particular, makes corresponding communication with a magnetically or inductively working transmitter/receiver pair possible. The reception coil can be arranged opposite the transmission coil, in such a manner that the magnetic field lines of the transmission coil can be received by the reception coil in the best manner possible, so as to make available the best possible data transmission.

Because signal losses through the wall of the hollow body naturally occur, the receiver can amplify the signal transmitted by the transmitter, so as to be able to compensate signal losses. In this way, even a signal that has been weakened to a few percent or per mille of the original strength can be amplified sufficiently so as to be able to process the signal further or evaluate it.

Also the data received by the receiver can be transmitted as a receiver of the receiver, so as to make easy implementation of signal amplification or noise suppression possible, because great losses can occur, if applicable, caused by the wall of the hollow body.

Alternatively or cumulatively to this, the data received by the receiver can be processed further by a micro-controller, and thereby corresponding signal processing or data evaluation can take place directly.

It is understood that, if applicable, signals can also be transmitted from the outside into the interior of the workpiece, for example so as to adapt the sensor to particular circumstances, in terms of its sensitivity, or so as to be able to transmit other signals to the drawing mandrel, to the transmitter or to the sensor. Accordingly, additional transmitters or receivers can also be provided on the outside or in the interior, or the transmitters or receivers described above can also be configured as receivers or transmitters.

Signal directed into the interior can also be used as energy carriers, so as to supply the transmitter provided in the interior or the sensor provided in the interior with energy.

The semi-finished product is preferably a hollow body that extends in the longitudinal expanse direction.

In particular, the semi-finished product or the tube or the workpiece can be metallic.

The sensor can comprise a transmitter, a micro-controller and/or a memory, so that it can preferably work independently.

The physical properties that can be measured by the sensor can be very varied.

Preferably, the position of the sensor in three-dimensional space can be measured by the sensor, i.e. it is possible to measure the position of the sensor in three-dimensional space by means of the sensor. The position of the drawing mandrel then follows from this. Depending on the concrete implementation, a geostationary position, a relative position or a position in a coordinate system defined from the outside, for example by means of an electrical, magnetic or electromagnetic field, can be measured. Here, however, all the known measures for measuring a position are fundamentally conceivable.

In particular, the sensor can comprise a nine-axis position sensor, which of course allows very precise position information.

Cumulatively or alternatively to this, the sensor can record the position in space in Euler coordinates, which have the advantage that a sufficiently precise measurement is possible, in particular after suitable calibration, since the drawing mandrel as such at first does not experience any overly great position changes during the forming process.

It is also conceivable that temperature, pressure and/or acceleration can be measured by means of the sensor, or that the sensor measures temperature pressure and/or acceleration. From these data, as well, valuable data regarding the forming process can be obtained from the interior of the hollow body or from the drawing mandrel itself, which data have not been accessible until now.

All of the physical properties yield valuable information for the drawing process, since the material behavior also changes as the physical properties, for example the temperature, pressure and/or acceleration change, so that if necessary, it is possible to intervene in the drawing process accordingly, so as to regulate it. In particular with regard to the given position of the drawing mandrel, conclusions can be drawn with regard to the drawing behavior.

It is understood that all of the measured physical properties can also be put into relation with one another, so as to obtain important data about the drawing behavior. For example, the temperature progression can be put into relation with a changing acceleration, as can a changing acceleration due to changes in pressure, and so on. The relationships of the physical properties that are possible from the measurement data lie within the general field of applications of a person skilled in the art. However, until now it was never possible to simply obtain these data, in the case of drawing machines of the stated type.

Preferably the workpiece extends, after it has moved past the drawing mandrel or the drawing ring, over at least two meters in terms of its longitudinal expanse direction. The invention is particularly suitable for long hollow bodies, for which it is extremely difficult to obtain information regarding the position or other physical data from the interior, in particular from the vicinity of the drawing mandrel, and to pass them on to the outside.

The workpiece is preferably metallic, preferably made of copper, aluminum, iron or steel. The invention is particularly suitable for metallic, in particular very long metallic hollow bodies, for which it is very difficult to obtain information regarding the position or other physical data from the interior, in particular in the vicinity of the drawing mandrel.

Measuring the position of the drawing mandrel is very advantageous, so as to check whether the drawing mandrel has the intended position during the drawing process or whether it has a deviating progression, for example on the basis of changing physical properties, so that possibly an intervention in the process, to regulate it, can be made at the earliest possible point in time.

In the present case, a tube is preferably an elongated hollow body, the length of which is generally significantly greater than a diameter. It is advantageous if the tube is produced from a relatively non-flexible material. In general, tubes possess a circular cross-section, which represents the optimal construction for the most common application cases. It is also conceivable that the tubes can also be produced with rectangular, oval and other cross-sections, for use as a static element having increased rigidity. Preferably, tubes can be used, for example, as a transport path of a pipeline for liquids, gases, or solid bodies capable of flow. Tubes can also be used as a design element in mechanical engineering, such as axles or shafts, for example. Use as a static element is also conceivable, such as, for example, in the form of a grid frame, as a semi-finished product for various applications, such as, for example, shock absorbers, or also the transport path of a pneumatic tube delivery system. The optimal range of use of a tube can be determined on the basis of its properties such as cross-section, material, surface quality, diameter, and pressure level.

In general, the preliminary material, in particular pre-finished tube material and workpieces or semi-manufactured products having the simplest form can be referred to as semi-finished products. Semi-finished products can preferably and generally consist of a single material, which was merely brought into a fundamental geometric shape. For example, simple profiles, rods, tubes, and plates made of metal, plastic or wood can be referred to as semi-finished products.

Workpieces can also already be given an individual shape in a preparatory production step, wherein further production steps are still provided for. In this case, they can also be referred to as blanks.

In the production technique that also includes the drawing machine, metal material are generally supplied as semi-finished products.

Metallic semi-finished products, in particular, are preferably not created directly by means of casting or similar molding methods, but rather in a second step, by means of reshaping or cutting methods such as chip-removing machining. Subsequently, a semi-finished product can be worked further, either to produce a finished product or to first produce a further semi-manufactured product.

Raw materials such as bulk raw materials, granulates, powders, liquids or gases are not included in semi-finished products, because in contrast to semi-finished products, they are not geometrically determined, solid bodies, and therefore no "semi-finishing" of the product has yet taken place. Ready-to-use components, ready-to-use construction elements, ready-to-use blocks and modules are also not included in semi-finished products, because these are used, to the greatest extent, in their original form.

Semi-finished products can be produced as an important element of efficient and cost-advantageous production, wherein they can be referred to as a "semi-finished material." They are generally designed in such a manner that they correspond as optimally as possible, in terms of shape and dimensions, to the product to be produced. Preferably material qualities and surface qualities are optimized for specific purposes of use and production methods, such as, for example, drawing methods.

The drawing device of the drawing machine is necessary in order to draw the workpiece along a longitudinal expanse direction, around the drawing mandrel and through the drawing ring. Since a drawing device, by its nature, draws a workpiece and does not drive it forward, in the present case the drawing device is preferably located behind drawing mandrel or the drawing ring. The drawing device engages on the workpiece, in other words on the workpiece that has already been formed. A drawing device can be configured, for example, as a caterpillar track, as a drawing cylinder, or as a drawing carriage machine.

A drawing mandrel is preferably formed from a wear-resistant and hard material, which furthermore has a round cross-sectional surface, for example. The cross-sectional surface of the drawing mandrel can preferably correspond to the cross-sectional surface of the semi-finished product or the formed tube. Thus, for example, drawing mandrels having an oval cross-sectional surface can also be used for oval tubes.

Accordingly, drawing rings can preferably also have round inner surfaces, so as to be able to form a round semi-finished product to produce a round tube. It is conceivable that the forming cross-sectional surface of the drawing mandrel is also configured to be oval, rectangular, or in some other way. It is understood that the cross-sectional shape of the drawing mandrel does not necessarily have to agree with the shape of the cross-sectional inner surface of the drawing ring, wherein, however, in general a similar cross-sectional shape of drawing mandrel and drawing ring is used, so as to achieve operationally reliable forming of the semi-finished product.

Drawing machines can serve for the production or machining of tubes that extend in the longitudinal expanse direction, from a semi-finished product, wherein the drawing method used by the drawing machine can also be called through-drawing. This is a production method and is part of tensile compressive forming, according to DIN 8584.

For example, drawing machines can be used for wire drawing, wherein the starting wire, which was produced by means of an extrusion method and subsequent rolling, is drawn through a drawing ring. Also, the production of copper tubes, in particular, is possible by way of a drawing machine, wherein the starting tube is produced by means of extrusion, for example.

During drawing of tubes, at which the present invention is also aimed, a tool situated in the tube, for example called a drawing mandrel or mandrel, is preferably used along with the drawing ring, or also called a die, so as to achieve a defined wall thickness. It is also conceivable, in the case of long tubes, in particular if these are not drawn straight, to guide the drawing mandrel in a "flying" manner.

Depending on the concrete embodiment, the outside diameter of the drawing mandrel can be slightly greater than the drawing ring diameter.

The drawing mandrel can become fixed in place during the drawing process, in particular ahead of the drawing ring, and the tube that is to be reduced in cross-section "flows" through between drawing ring and drawing mandrel.

In the case of steel tubes and profiles composed of steel and copper, drawing can primarily serve for final treatment, to achieve a great level of dimensional stability or a smooth surface.

Fundamentally, different construction forms of drawing machines can be differentiated. Drum drawing machines preferably serve for machining of small material dimensions having a great length, such as, for example, wire, tubes having a small diameter, wherein the introduction of force can take place by way of a drum, around which the material strand is wound after the die. Furthermore a drawing machine can also be configured as a straight-pull drawing bench, which is advantageously used for the production and machining of relatively short tubes, in particular up to about 30 meters, or large cross-sections, such as profiles and tubes having a large diameter. In this regard, one or also multiple workpieces of the same type can be drawn through the die, wherein the introduction of force takes place at the starting workpiece.

The design of drawing machines as a continuous drawing machine, which is fundamentally suitable for a great length range of the workpieces, is also conceivable. Preferably these are used for tubes having a medium or small diameter, as well as a medium length. The method of functioning of these so-called continuous machines is based on the fact that multiple clamping devices move the material to be drawn along in such a manner that at least one clamping device is always in engagement with the workpiece. An advantageous embodiment provides for two clamping devices controlled by way of special link rolls, for example also in the form of drawing carriages. Other advantageous embodiments possess clamping jaws that are mounted on two chains that are mounted against one another and run synchronously.

It is advantageous if the decrease in cross-section during drawing and thereby the diameter of the draw plate is dimensioned in such a manner that the tensile strength or the yield strength of the material is not exceeded by the drawing force. In particular for this reason, the drawing process can also take place in multiple steps. It is conceivable that during cold-rolling of steel and brass materials, soft annealing or patenting is necessary between the steps, and this might not be necessary in the case of copper materials.

The data and information made available in this manner can also serve, in particular, for regulation or the apparatus or for corresponding process management.

It is understood that the characteristics of the solutions described above and in the claims can also be combined, as applicable, so as to be able to implement the advantages cumulatively.

Figure 2:
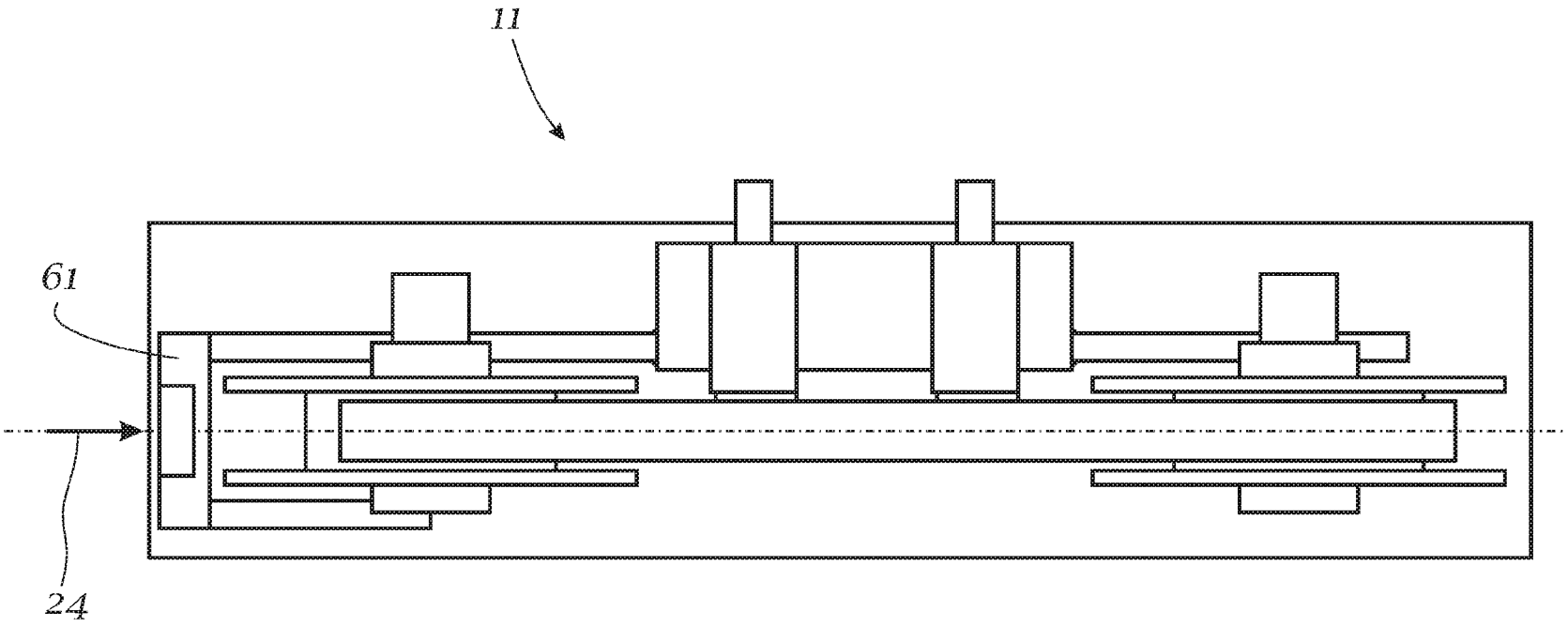
Figure 3:
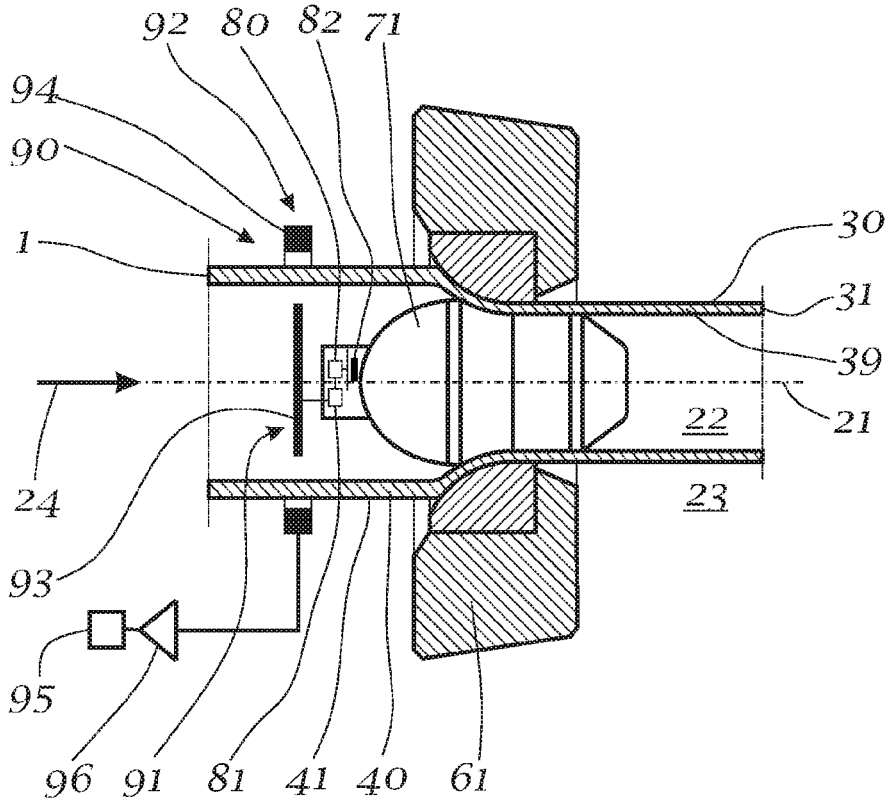

Further advantages, goals, and properties of the present invention will be explained using the following description of exemplary embodiments, which are also shown, in particular, in the attached drawing. The drawing shows:

FIG. 1 a schematic side view of a drawing machine;

FIG. 2 the drawing machine according to FIG. 1 in a schematic top view;

FIG. 3 an enlarged representation of the drawing ring and of the drawing mandrel of the arrangement according to FIGS. 1 and 2, in a schematic side view.

In a first embodiment, as it is also shown in FIGS. 1 to 3, a drawing machine 11 comprises a drawing device 51, a drawing ring 61, a drawing mandrel 71, as well as an apparatus 90 for data transmission.

A workpiece 1 is in engagement with the drawing device 51, wherein the drawing device 51, viewed in the working direction 24, is situated or is arranged behind the drawing ring 61 and the drawing mandrel 71. The workpiece 1 extends along a longitudinal expanse direction 21, which is oriented in the same way as the working direction 24.

The workpiece 1 presents itself as a semi-finished product 40 configured as a tube 41.

The workpiece 1 is configured with a wall 39.

Furthermore, the workpiece 1 has an interior 22 as well as an exterior 23.

In addition, the workpiece 1, viewed in the working direction 24, is behind the drawing ring 61 or the drawing mandrel 71 as a hollow body 30 or tube 31. The drawing device 51 thereby engages into the tube 31 or onto it.

The drawing mandrel 71 is arranged in the interior 22 of the workpiece 1, while the drawing ring 61 is arranged on the exterior 23 of the workpiece, wherein the drawing mandrel 71 and the drawing ring 61 each touch the wall 39 of the workpiece 1.

In the embodiment described, a sensor 80 is arranged in the drawing mandrel 71, wherein the sensor is arranged, viewed in the working direction 24, ahead of the drawing mandrel 71 in this exemplary embodiment, so that the sensor is situated ahead of the drawing ring 61 in the non-formed region of the workpiece 1, viewed in the working direction 24.

The sensor 80 of the present exemplary embodiment according to FIGS. 1 to 3 works together with a micro-controller 81 and a memory 82, so that it can work in a relatively autarchic manner.

In particular, the micro-controller 81 and/or the memory 82 can also be provided in the sensor 80 or in the transmitter 91. Likewise, it is conceivable that transmitter 91 and sensor 80 form a structural unit.

The apparatus 90 for data transmission comprises a transmitter 91 as well as a receiver 92. In the present exemplary embodiment, the transmitter 91 is configured as a transmission coil 93. The receiver 92 is configured as a reception coil 94. It is understood that other configurations are also possible here, in deviating embodiments.

The reception coil 94 is connected, by way of an electric line 97, with a receiver 96 and with a micro-controller 95 that is switched after the receiver 96. In this exemplary embodiment, the receiver 96 serves for signal amplification, while an evaluation takes place by way of the micro-controller 95. It is understood that other configurations are also possible here, in deviating embodiments.

The reception coil is arranged at the axial height of the transmission coil 93, in the longitudinal expanse direction 21.

The transmission coil 93 is connected with the sensor 80 by way of an electric line 97.

The drawing mandrel 71 has a round cross-section.

The drawing device 51 draws the workpiece 1 in the longitudinal expanse direction 21 and thereby produces advancing of the workpiece in the working direction 24. The drawing device 51 is configured as a caterpillar track and engages on the workpiece 1, wherein it draws the workpiece 1 through the drawing ring 61 and over the drawing mandrel 71. As a result, drawing ring 61 or drawing mandrel 71 act on the semi-finished product 40 to form it. It is understood that in deviating embodiments, other drawing devices 51 such as, for example, carriage drawing machines or drum drawing machines, can also be used in this regard.

The drawing ring 61 acts on the semi-finished product 40, forming it, and determines the outside diameter of the formed hollow body 30 and thereby of the tube 31 by its inside diameter.

The drawing mandrel 71 determines the inside diameter of the tube 31 formed from the semi-finished product 40, by its outside diameter. The wall 39 of the workpiece is determined by the difference between the inside diameter of the drawing ring 61 and the outside diameter of the drawing mandrel 71.

The sensor 80 arranged on the drawing mandrel 71 detects physical properties without interruption, in particular during the drawing process. Such properties can be, for example, temperature, pressure, acceleration and/or the precise position of the sensor 80. Because of the fact that the sensor 80 is arranged on the drawing mandrel 71, in other words directly connected with the drawing mandrel 71 or mounted on it, and the precise dimensions of the drawing mandrel 71 are known, the precise position of the entire drawing mandrel 71 can be determined to its full extent.

Since the sensor 80 is arranged in the interior 22 of the workpiece 1, the sensor 80 also measures the physical properties in the interior 22 of the workpiece.

The measurement data that the sensor 80 records are passed on to the micro-controller 81 and directly processed further by the latter. Furthermore, a memory 82 supplies energy to the sensor 80, and thereby the latter is supplied with energy for the measuring process. Subsequently the measurement data are transmitted from the sensor 80 to the transmission coil 93, which is situated in the immediate vicinity, also in the interior 22 of the workpiece 1, by way of an electric line 97. The energy of the memory 82 also gets into the transmission coil 93, so that the latter can transmit a signal.

The transmission coil 93 is arranged radially around the longitudinal expanse direction 21, i.e. coaxial to the workpiece 1 or to the semi-finished product 40.

In this exemplary embodiment, the measurement data are inductively transmitted to the reception coil 94 by way of the transmission coil 93, wherein magnetic fields naturally occur.

It is understood that in other exemplary embodiments, other transmitter/receiver combinations, such as capacitive or electromagnetic combinations, can be provided alternatively or cumulatively.

The reception coil 94 receives the measurement data from the transmission coil 93 and passes them on to a receiver 96, which has the task of amplifying the received signal, since losses of the signal occur due to transmission through the wall 39 of the workpiece 1. The signal, which has been amplified again by the receiver 96, is passed on to a micro-controller 95 that processes the measurement data further.

It is also conceivable that the apparatus 90 for data transmission can be configured in a hard-wired manner, wherein then a hard-wired connection between transmitter 91 and receiver 92 must be made available.

It is also conceivable that the transmission from transmitter 91 to receiver 92 takes place electrically, and this must be implemented by way of a capacitive apparatus.

In a further possible embodiment, the transmission between transmitter 91 and receiver 92 could take place electromagnetically, wherein the hollow workpiece, for example, is used as a hollow conductor for passing the signal on.

The measurement data can then be used, for example, for quality control or also for control or regulation of the drawing process.

REFERENCE SYMBOL LIST

1 workpiece
11 drawing machine
21 longitudinal expanse direction
22 interior of the workpiece 1
23 exterior of the workpiece 1
24 working direction
30 hollow body
31 tube
39 wall of the workpiece 1
40 semi-finished product
41 tube
51 drawing device
61 drawing ring
71 drawing mandrel
80 sensor
81 micro-controller
82 memory
90 apparatus for data transmission
91 transmitter
92 receiver
93 transmission coil
94 reception coil
95 micro-controller
96 receiver
97 electric line

The invention claimed is:

1. A drawing machine for the production or machining of tubes composed of a semi-finished product, wherein the tubes extend in a longitudinal expanse direction, wherein the drawing machine comprises a drawing device for drawing a hollow workpiece formed by the tube and the semi-finished product along the longitudinal expanse direction, a drawing ring, and a drawing mandrel, and acts on the workpiece with the drawing mandrel and the drawing ring, forming the workpiece, while the workpiece is being drawn around the drawing mandrel and through the drawing ring under the control of the drawing device, wherein a sensor, a micro-controller, and a memory are arranged on the drawing mandrel and the sensor is configured to cooperate with the micro-controller and the memory and configured to measure a position of the sensor in three-dimensional space, wherein the drawing machine further comprises an apparatus for transmission of data from an interior of the workpiece using a transmitter arranged in the interior of the workpiece and a receiver arranged outside of the workpiece, and the receiver and the transmitter are configured to communicate wirelessly with one another, wherein the wireless communication between the transmitter and the receiver is configured inductively.

2. The drawing machine according to claim 1, wherein the transmitter is configured to transmit a signal that comprises the data through a wall of the workpiece, and the receiver is arranged at an axial height of the transmitter with reference to the longitudinal expanse direction.

3. The drawing machine according to claim 1, wherein the transmitter comprises a transmission coil.

4. The drawing machine according to claim 1, wherein the receiver comprises a reception coil that surrounds the workpiece.

5. The drawing machine according to claim 1, wherein the apparatus comprises a further receiver and/or a further micro-controller.

6. The drawing machine according to claim 1, wherein the sensor has the transmitter and/or the micro-controller and the transmitter is an electric or electronic transmitter.

7. The drawing machine according to claim 1, wherein the transmitter is arranged on the drawing mandrel.

8. The drawing machine according to claim 1, wherein the sensor comprises a nine-axis position sensor and/or wherein the sensor records the position in space of the sensor in Euler coordinates.

9. The drawing machine according to claim 1, wherein the workpiece, after the workpiece has moved past the drawing mandrel or the drawing ring, extends over at least 2 m in the longitudinal expanse direction.

10. The drawing machine according to claim 1, wherein the workpiece is metallic.

11. The drawing machine according to claim 1, wherein the sensor is configured to measure temperature and/or pressure and/or acceleration.

12. A drawing method for the production or machining of tubes composed of a semi-finished product, wherein the tubes extend in a longitudinal expanse direction, wherein using a drawing device, a hollow workpiece formed by the tube and the semi-finished product is drawn along the longitudinal expanse direction and the workpiece is acted on with the drawing mandrel and the drawing ring forming the workpiece, while the workpiece is being drawn around the drawing mandrel and through the drawing ring under the control of the drawing device, wherein a sensor, a micro-controller, and a memory are arranged on the drawing mandrel and the sensor cooperates with the micro-controller and the memory, and the sensor measures a position of the sensor in three-dimensional space, wherein the mandrel further comprises an apparatus for transmission of data from an interior of the workpiece using a transmitter arranged in the interior of the workpiece and a receiver arranged outside of the workpiece, and the receiver and the transmitter are configured to communicate wirelessly with one another, wherein the wireless communication between the transmitter and the receiver is configured inductively.

13. The drawing method according to claim 12, wherein the transmitter transmits the signal that comprises the data through a wall of the workpiece and the receiver is arranged at an axial height of the transmitter with reference to the longitudinal expanse direction.

14. The drawing method according to claim 12, wherein the data are transmitted by a transmission coil.

15. The drawing method according to claim 12, wherein the data are received by a reception coil of the receiver, wherein the reception coil surrounds the tube.

16. The drawing method according to claim 12, wherein the receiver amplifies the signal transmitted by the transmitter.

17. The drawing method according to claim 12, wherein the data received by the receiver are transmitted to a further receiver and/or processed further by the micro-controller.

18. The drawing method according to claim 12, wherein the micro-controller arranged on the drawing mandrel processes the data of the sensor further.

19. The drawing method according to claim 12, wherein the semi-finished product is a hollow body that extends in the longitudinal expanse direction.

20. The method according to claim 12, wherein the sensor is further configured to measure temperature and/or pressure and/or acceleration.

21. A drawing mandrel for use in a drawing machine and/or for use in a drawing method for the production or machining of tubes composed of a semi-finished product, wherein the tubes extend in a longitudinal expanse direction, wherein the drawing mandrel is a flying drawing mandrel, wherein a sensor, a micro-controller, and a memory are arranged on the drawing mandrel, and wherein the sensor is configured to cooperate with the micro-controller and the memory and to measure a position of the sensor in three-dimensional space, wherein the mandrel further comprises an apparatus for transmission of data from an interior of the workpiece using a transmitter arranged in the interior of the workpiece and a receiver arranged outside of the workpiece, and the receiver and the transmitter are configured to communicate wirelessly with one another, wherein the wireless communication between the transmitter and the receiver is configured inductively.

22. The drawing mandrel according to claim 21, wherein the sensor is further configured to measure temperature and/or pressure and/or acceleration.

* * * * *